United States Patent [19]

Hishida et al.

[11] 4,074,799

[45] Feb. 21, 1978

[54] RIBBON CARTRIDGE HAVING SLACK PREVENTING MEANS

[75] Inventors: Yukio Hishida, Nagoya; Tomoyoshi Watanabe, Chiryu; Takanobu Hirayama, Chita; Hideo Asakura, Nagoya, all of Japan

[73] Assignee: Brother Kogyo Kabushiki Kaisha, Nagoya, Japan

[21] Appl. No.: 704,801

[22] Filed: July 13, 1976

[30] Foreign Application Priority Data

July 17, 1975 Japan ..... 50-87719
July 17, 1975 Japan ..... 50-87720

[51] Int. Cl.[2] ..... B41J 33/14
[52] U.S. Cl. ..... 197/151
[58] Field of Search ..... 197/151, 168, 175

[56] References Cited

U.S. PATENT DOCUMENTS

| | | | |
|---|---|---|---|
| 581,276 | 4/1897 | Febiger | 197/175 |
| 2,755,905 | 7/1956 | Segui | 197/168 |
| 3,356,202 | 12/1967 | Goff | 197/151 |
| 3,442,366 | 5/1969 | Spears | 197/151 |
| 3,490,671 | 1/1970 | Hladky | 197/168 UX |
| 3,621,968 | 11/1971 | Kondur | 197/151 |
| 3,804,227 | 4/1974 | Cappotto et al. | 197/151 |
| 3,877,561 | 4/1975 | Guerrini et al. | 197/151 |
| 3,904,017 | 9/1975 | Frechette | 197/151 |
| 3,923,141 | 12/1975 | Hengelhaupt | 197/175 X |
| 3,977,511 | 8/1976 | Hengelhaupt | 197/151 |

*Primary Examiner*—Ernest T. Wright, Jr.
*Attorney, Agent, or Firm*—George B. Oujevolk

[57] ABSTRACT

A ribbon cartridge includes a pair of housings having apertures, a pair of ribbon spools rotatably supported in the housings, and a ribbon wound on the spools. A portion of the ribbon is exposed to the outside of the housings through the apertures when the ribbon is fed from one spool to the other. Each housing rotatably supporting a hold member. The hold member has a holding portion which is movable across a ribbon passage within the respective housings for holding the ribbon and has an engaging portion which is engageable with teeth on a flange of each spool, and each hold member is biased by a spring member. When the cartridge is removed from the typewriter, the holding portion is moved across the ribbon passage and a portion of the ribbon slackened and exposed from the housing is tensioned. The engaging portion prevents the rotation of the respective spools by the biasing force of the spring member, and when the cartridge is installed in the typewriter, the hold member is retracted to a released position by a retract member of the typewriter.

6 Claims, 3 Drawing Figures

RIBBON CARTRIDGE HAVING SLACK PREVENTING MEANS

BACKGROUND OF THE INVENTION

This invention relates to a ribbon cartridge having slack prevention means, when the ribbon cartridge has been removed from the typewriter.

DESCRIPTION OF THE PRIOR ART

Hitherto, a ribbon cartridge for a typewriter in common use has been such that a pair of spools are rotatably supported in two housings having apertures for the passage of a printing ribbon, and the printing ribbon is wound on the respective spools. A portion of the ribbon is adapted to be exposed to the outside of the housings through the apertures when the ribbon is fed from one spool to the other. With such a construction, when it is desired to install the ribbon cartridge in the typewriter, a portion of the printing ribbon exposed from both apertures of the housings has to be inserted in a ribbon vibrator of the typewriter. The ribbon vibrator is adapted to be vertically moved for guiding the ribbon from a lowered rest position to an elevated printing position. This vertical movement of the ribbon vibrator causes slackening of the ribbon in the portion running between both apertures of these housings. Accordingly, the portion of the ribbon exposed from the housings remains slack, even if the ribbon cartridge is removed from the typewriter.

Should the ribbon cartridge thus removed be carried from one place to the other, with a portion of ribbon maintained slackened, occasionally that portion of ribbon which is slackened and exposed would be inadvertently caught by the other parts of the typewriter, resulting in unwantedly bringing out the ribbon from the apertures of the housings to a greater extent than necessary and breaking the ribbon, or cause the unwanted rotation of the spools within the housings, leading to the slackening of the ribbon therein. When it is desired to reset the ribbon cartridge in the typewriter, the portion of the ribbon slackened and running between both apertures of the housings causes difficulties in insertion of the ribbon into the ribbon vibrator. It has been customary in such a case that a machine operator manually turns one of the spools in the ribbon take-up direction for tightening the ribbon prior to installation of the ribbon cartridge in the typewriter. Such is troublesome and tends to be missed by the operator.

OBJECTS OF THE INVENTION

It is accordingly an object of the present invention to provide a typewriter, wherein the ribbon cartridge has been removed from the typewriter, a portion of the ribbon slackened and exposed from the apertures of the housings is automatically tensioned, and the ribbon is partially held under pressure within the cartridge, so that the ribbon is free from being drawn from the apertures of the housings excessively, and on the other hand, when the cartridge is installed in the typewriter, the pressure for holding the ribbon within the cartridge is automatically released, thereby permitting the ribbon to travel freely.

It is an other object of the present invention to provide a typewriter, wherein when a ribbon cartridge is removed from the typewriter, a hold member is biased against a flange of each spool, so as to arrest the spool in the locked position, whereby an unwanted rotation of respective spools during the carrying of the cartridge is prevented, with the freedom of the slackening of the ribbon, and when the ribbon cartridge is installed in the typewriter, the hold member is automatically returned to a released position by means of a retract member, whereby the respective spools are free to rotate.

It is still another object of the present invention to provide a typewriter, wherein when a ribbon cartridge is removed from the typewriter, a hold member is biased by the action of a spring in a direction to tension the ribbon, thereby eliminating the slackening of the ribbon in a portion exposed from the apertures of the housings of the cartridge, as well as retaining the respective ribbon spools in a locked position within the housings, whereby an unwanted rotation of these spools is prevented, and on the other hand, when the ribbon cartridge is installed in the typewriter, the hold member is biased in the direction opposite to the direction of tensioning the ribbon by means of a retract member provided in the typewriter, thereby releasing the ribbon and spools from the locked position.

SUMMARY OF THE INVENTION

According to the inventive concept there is provided a typewriter which is adapted to receive a ribbon cartridge which includes a pair of ribbon housings having apertures and rigidly connected to each other, a pair of ribbon spools rotatably supported in the respective housings, and the ribbon wound on the spools, a portion of the ribbon being adapted to be exposed to the outside of the housings through the apertures when the ribbon is fed from one spool to the other; the ribbon cartridge comprises a pair of hold members rotatably supported in the respective housings. Each hold member has a holding portion which is movable across a ribbon passage within the respective housings for holding the ribbon and co-operating with a projection in the housing, an engaging portion of the hold member engageable with one of circumferential teeth of one flange of each spool, and each hold member is biased by a spring member, so that the holding portion is biased toward the projection of the housing and the engaging portion is engaged with one of the teeth of the flange. In this way the ribbon is free from slack in the part which is exposed to the outside of the housings by the ribbon holding action of the holding member and the engaging portion prevents the rotation of the respective spools. Further, the typewriter has a pair of retract members for retracting each hold member against the force of each spring member. When the ribbon cartridge is installed in the typewriter, the holding portion is retracted from the ribbon passage and the engaging portion is disengaged with the teeth of each spool.

The above and other objects, features and advantages of the invention will become more apparent from the following description and appended claims, taken in conjunction with the accompanying drawing which shows by way of example a preferred embodiment of the invention.

DETAILED DESCRIPTION OF THE INVENTION

Figure 1:
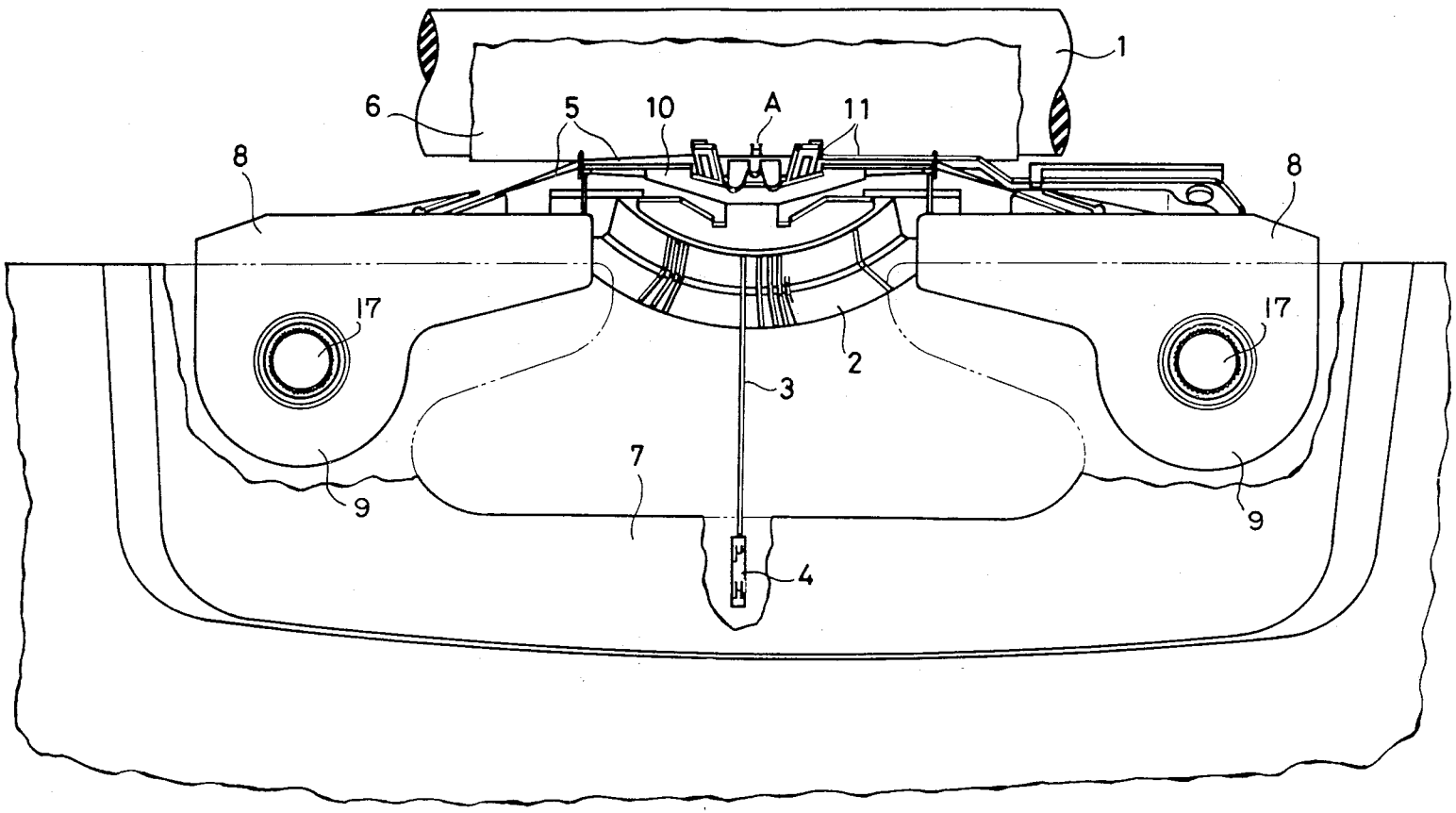
FIG. 1 is a fragmentary plan view of a typewriter having type bars in which the cartridge of the present invention is embodied.

Referring to FIG. 1, a platen 1 is rotatably supported on the typewriter carriage in the rear portion of the typewriter. A plurality of type bars 3 respectively have type characters 4 on the end portion and are pivotally mounted on a type bar segment 2. When any of the type bars 3 strike through a printing ribbon 5 at a print point A on the platen 1, a character 4 on the type bar 3 is printed on a sheet of paper 6 on the platen 1.

A top cover 7 which constitutes a part of the typewriter cover is removably supported on the frame of the typewriter. A ribbon cartridge 8 houses therein the ribbon 5 and is removably supported so as to be readily installed in or removed from the typewriter after removal of the top cover 7.

Figure 2:
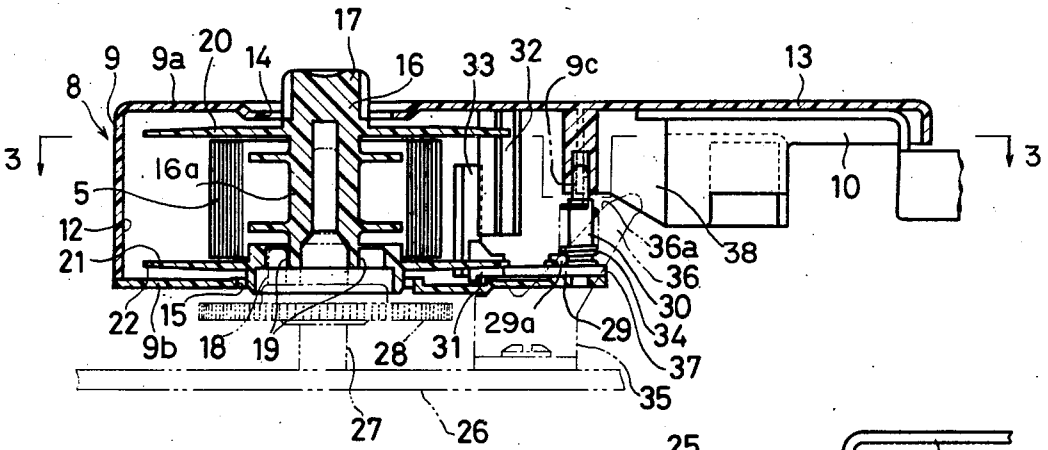
FIG. 2 is a longitudinal cross sectional view of the cartridge with its left half only showing; and, FIG. 3 is a cross sectional view taken along the line 3—3 of FIG. 2.
Figure 3:
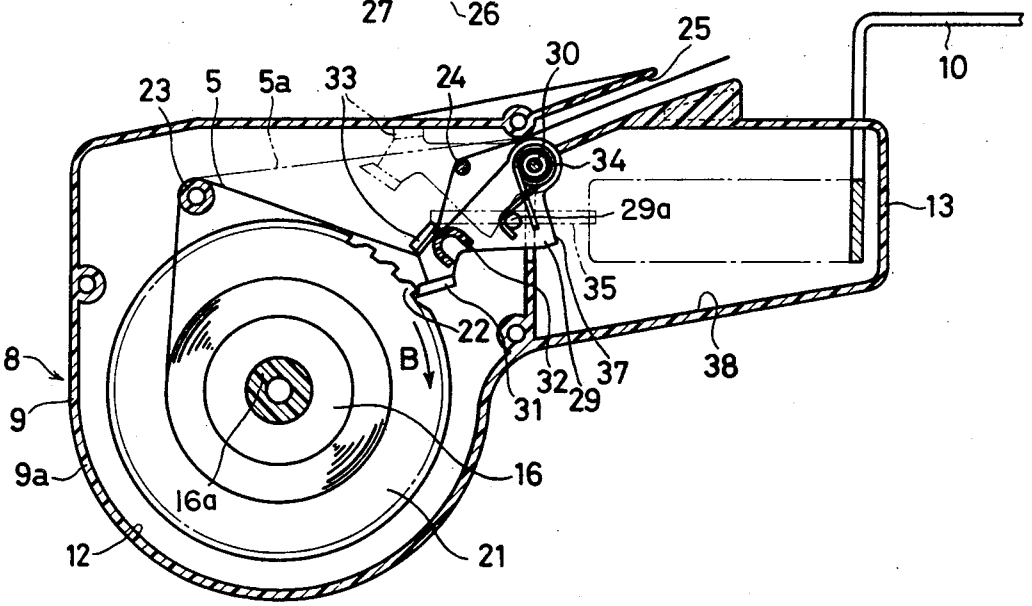

A pair of housings 9 made of a plastic material are disposed on the left and right hand sides as viewed from the print point A and interconnected to each other by a connecting arm 10 made of a steel plate. Both end portions of the connecting arm 10 are fixed to the inside surfaces of the housings 9 (only the left end portion of the connecting arm 10 is shown in FIGS. 2 and 3), and the center portion of the connecting arm 10 is disposed near the platen 1 and is formed substantially in U-shape as seen from the front side of the typewriter to avoid the print point A as illustrated in FIG. 1.

A ribbon vibrator 11 is provided with known ribbon guide apertures into which the ribbon 5 is to be inserted. The ribbon vibrator 11 is normally maintained in a lowered, rest position, below the print point A, and adapted to be vertically moved to an elevated position in front of the print point A, to thereby guide the ribbon 5 inserted in the guide apertures to the elevated position in response to the printing operation. The ribbon cartridge 8 is symmetrical in constuction with respect to the print point A, and hence only the left half of the cartridge 8 is shown with the other half omitted in FIG. 2 and FIG. 3, for simplicity of explanation.

The housing 9 is composed of an upper cover 9*a* extending from the top wall to the side wall thereof, and a bottom plate 9*b* closing the bottom thereof. The housing 9 has a ribbon chamber 12 for accommodating the ribbon 5, and a connecting portion 13 extending rightwards as viewed in FIG. 2. To the connecting portion 13 is fastened the left end portion of the connecting arm 10 by the caulking process.

In the central portions of the top wall of the upper cover 9*a* and the bottom plate 9*b* of the housing 9, which define the ribbon chamber 12, are provided round apertures 14 and 15, respectively. A spool 16 is housed in the ribbon chamber 12 of the housing 9. The spool 16 has a knob 17 on the top portion and a plurality of holes 19 which are provided on the bottom surface in the vicinity of the center of the spool 16 in a manner to be engagable with a drive pin 18 of a ribbon drive mechanism of the typewriter. The knob 17 and the bottom surface of the spool 16 are exposed upwards and downwards through the round apertures 14 and 15, respectively. The spool 16 is loosely fitted in a manner to be freely movable within the round apertures 14 and 15. The spool 16 has upper and lower flanges 20 and 21 which are in parallel relationship within the housing 9. There are provided a plurality of serrated teeth 22 on the circumference of the lower flange 21 of the spool 16, as seen in FIG. 3.

The ribbon 5 is wound on the center shaft 16*a* of the spool 16 between the upper and lower flanges 20 and 21, with one end of the ribbon 5 fastened to the center shaft 16*a*. Thus, the ribbon 5 travels rightwards under guidance of the guide pins 23 and 24 projecting from the upper cover 9*a*, through an aperture 25 provided in the rear portion of the housing 9 and then is exposed to the outside of the housing 9.

Shown by a two-dotted line below the housing 9 in FIG. 2 is part of the ribbon drive mechanism disposed in the typewriter. A drive shaft 27 is rotatably supported on a support plate 26 which is part of a machine frame. A drive disk 28 is rigid with the drive shaft 27, so that both members 28 and 27 will be rotated intermittently in a ribbon take-up direction (a direction opposite to the arrow B in FIG. 3) in response to the printing operation. The drive pin 18 is adapted to rotate integrally with the drive disk 28 and fitted in one of the holes 19, thereby rotating the spool 16.

The ribbon drive mechanism of the same construction is provided below the right hand housing 9. Only one of the left and right hand ribbon drive mechanisms is actuated by an ordinary ribbon reversing mechanism (not shown) for changing the ribbon take-up direction of the ribbon 5, while the spool 16 connected to the other ribbon drive mechanism is maintained freely rotatable.

A hold member 29 is journaled on a shaft 30 provided in the vicinity of the aperture 25 of the housing 9, as seen in FIGS. 2 and 3. The hold member 29 has in its free end portion a pawl-shaped engaging portion 31 engagable with one of serrated teeth 22 provided on the lower flange 21, and a holding portion 33 which is adapted to be movable toward an arresting projection 32 downwardly extending from the upper cover 9*a* of the housing 9 and having a U-shape in cross section.

A spring 34 is biasing the hold member 29 in the counter-clockwise direction as viewed in FIG. 3 and the center portion of the spring 34 is coiled about the shaft 30, its lower end is fastened to a projection 29*a* on the hold member 29, and the upper end thereof is fastened to a shoulder portion 9*c* (shown by one dotted line in FIG. 2) of the upper cover 9*a* of the housing 9. The bottom of the housing 9 is open in a portion below that of the hold member 29, as seen in FIG. 2, so that the operator's fingers may be inserted through the opening 38 in the housing 9 so as to manually rotate the hold member 29 in the clockwise direction as viewed in FIG. 3 against the force of the spring 34, thereby retracting the hold member 29 from the lock position.

Shown at 35 in FIG. 2 is a retract member which is rigid with the support plate 26 of the typewriter. The retract member 35 has an upwardly extending arm 36, whose upper edge serves as a cam edge 36*a*, said cam edge 36*a* being adapted to engage the right end edge 37 of the hold member 29.

With the ribbon cartridge 8 thus constructed, the ribbon 5 wound on the spool 16 is fed under guidance of the guide pins 23 and 24, then passed through a gap between the arresting projection 32 and the holding portion 33 and eventually taken up by the other spool 16 in the other housing 9. When the cartridge 8 has been removed from the typewriter, the hold member 29 is biased by the action of the spring 34 in a direction of bringing the holding portion 33 toward the arresting projection 32, whereby the part of the ribbon 5 slackened and exposed from the housing 9 is tensioned, while the ribbon 5 is tightly held between the arresting projection 32 and the holding portion 33, thereby being prevented from an unwanted travelling towards the outside of the housing 9.

At this stage, the engaging portion 31 of the hold member 29 is located within a locus of rotation of the serrated teeth 22 of the lower flange 21, such that the spool 16 can not be rotated in the direction of arrow B in FIG. 3. Thereby the ribbon 5 wound on the spool 16 is prevented from slackening within the housing 9 during transportation of the ribbon cartridge 8.

When the ribbon cartridge 8 is installed on the ribbon drive mechanism (part of which is shown by two dotted lines in FIG. 2), the hold member 29 is brought into engagement with the retract member 35 in the typewriter. Then, the hold member 29 is rotated in the clockwise direction as viewed in FIG. 3 by the cam action of the cam edge 36*a* of the retract member 35, whereby the hold member 29 is retained in a released position as shown by a two-dotted line in FIG. 3. Consequently, the engaging portion 31 of the hold member 29 is retracted from the engagement with one of the serrated teeth 22 of the lower flange 21, whereby the spool 16 becomes free to rotate within the housing 9, thereby permitting the ribbon 5 to travel freely. Thus, the ribbon 5 permits travel in tension within housing 9 via an ordinary ribbon passage 5*a* as shown by a two-dotted line in FIG. 3, in response to the printing operation.

Since the ribbon vibrator 11 vertically reciprocates in front of the printing point A in response to the printing operation, the ribbon 5 becomes slackened in the portion exposed from the housing 9 to such an extent that it does not interfere with the vertical motion of the vibrator 11.

If the ribbon cartridge 8 is removed from the typewriter after the ribbon 5 has been removed from the ribbon vibrator 11, then the hold member 29 will disengage from the retract member 35 and the hold member 29 is rotated towards the locked position by the action of the spring 34 in which the holding portion 33 moves across the ribbon passage 5*a* and the engaging portion 31 moves toward the spool 16. At this time, the ribbon 5 is partly held under the pressure between the holding portion 33 and the arresting projection 32, as shown by a solid line in FIG. 3, and the engaging portion 31 is engaged with one of serrated teeth 22. Thus, the portion of the ribbon 5 exposed from the housing 9 is pulled into the housing 9, and the portion of the ribbon 5 slackened and exposed from the housing 9 is tensioned, since the ribbon 5 is tightly held between the holding portion 33 and the arresting projection 32, and the spool 16 is not rotated in the direction of arrow B in FIG. 3 by the engagement of the engaging portion 31 with one of serrated teeth 22.

When the holding portion 33 is moved across the ribbon passage 5*a* to a holding position, the ribbon 5 tends to travel from the spool 16 towards the aperture 25, but this movement of the ribbon 5 towards the aperture 25 is weakened due to friction of the spool 16 relative to the housing 9.

We claim:

1. A ribbon cartridge having slack preventing means, for a typewriter provided with ribbon drive means, said ribbon cartridge including a pair of ribbon housings rigidly connected to each other, each of said housings having an aperture, a pair of spools rotatably supported within said housings, said spools being operably connectable to said ribbon drive means, and a ribbon wound on said spools at the both ends thereof, a portion of said ribbon being exposed to the outside of said housings through said apertures when said ribbon is fed from one spool to the other; the improvement comprising:

a. a pair of hold members rotatably supported in said housings;

b. a holding portion on each of said hold members, said holding portion being movable across a ribbon passage within each of said housings, and cooperating with one portion of the housing for holding said ribbon;

c. a pair of spring members for biasing respective hold members toward said one portion of the housing; and d. a pair of retract members provided in the typewriter, respectively having a cam edge to be engagable with one of said hold members for retracting said holding portions from said ribbon passage against the biasing force of said spring members, when the ribbon cartridge is installed in the typewriter, so that when said ribbon cartridge has been removed from the typewriter, said ribbon is free from slackening in the portion which is exposed to the outside of said housings by the ribbon holding action of said hold members.

2. A ribbon cartridge as defined in claim 1 said one portion of the housing being formed with a projection extending downwardly from an upper cover of said housing, and each of said holding portion of said hold members being biased toward said projection by each of said spring members for holding said ribbon between said holding portion and said projection.

3. A ribbon cartridge as defined in claim 1, each of said spools having a flange, a pair of engaging members mounted in said housings and movable to engagement with said respective flanges, said pair of spring members respectively biasing said engaging members toward engagement with the respective flanges, and said retract members retracting respective engaging members from said flanges against the biasing force of said spring members, when the ribbon cartridge is installed in the typewriter, so that said engaging members prevent rotation of the respective spools by the engagement of said engaging members with said flanges when the cartridge has been removed from the typewriter.

4. A ribbon cartridge as defined in claim 3 wherein, said flanges of the respective spools have a plurality of teeth on the circumferential edge, and said engaging members have an engaging portion engagable with one of said teeth.

5. A ribbon cartridge as defined in claim 1 wherein said spools have flanges and respective hold members have an engaging portion engagable with said respective flanges for preventing rotation thereof.

6. A ribbon cartridge as defined in claim 5 wherein said flanges of the respective spools have a plurality of teeth on the circumferential edge and said engaging portion of said hold members are engagable with one of said teeth.

* * * * *